US005230738A

United States Patent [19]

Wheeler

[11] Patent Number: 5,230,738

[45] Date of Patent: Jul. 27, 1993

[54] MASKING DEVICE

[76] Inventor: Robert A. Wheeler, 158 N. Glendora Ave., No. W, Glendora, Calif. 91740

[21] Appl. No.: 809,333

[22] Filed: Dec. 18, 1991

[51] Int. Cl.[5] ..... B05C 11/00

[52] U.S. Cl. ..... 118/504; 52/202; 52/222; 52/DIG. 12; 160/327; 118/505

[58] Field of Search ..... 118/504, 505; 52/202, 52/222, DIG. 12; 160/327, 354

[56] References Cited

U.S. PATENT DOCUMENTS

| | | | |
|---|---|---|---|
| Re. 32,508 | 9/1987 | Werner | 52/202 |
| 2,922,392 | 1/1960 | Mund | 118/505 |
| 3,429,296 | 2/1969 | Legre | 118/504 |
| 4,175,357 | 11/1979 | Goldhaber | 52/202 |
| 4,233,790 | 11/1980 | Meadows | 52/222 |
| 4,351,137 | 9/1982 | Enyart et al. | 52/202 |
| 4,625,490 | 12/1986 | Baslow | 160/327 |
| 4,986,332 | 1/1991 | Lanuza | 160/327 |
| 5,058,340 | 10/1991 | Muller | 52/222 |

FOREIGN PATENT DOCUMENTS

| | | | |
|---|---|---|---|
| 1559954 | 1/1972 | Fed. Rep. of Germany | 52/202 |
| 104136 | 6/1964 | Norway | 160/327 |

*Primary Examiner*—W. Gary Jones

*Assistant Examiner*—Todd J. Burns

*Attorney, Agent, or Firm*—Christie, Parker & Hale

[57] ABSTRACT

A pliable, resilient retaining means integrated with an area to be masked in an architectural structure, extending over and substantially covering a channel about the perimeter of the area. The retaining means is attached to the channel wall proximate the area to be masked and is inwardly displaceable, allowing for the insertion and retention of non-adhesive paper or plastic masking material. The resilience of the retaining means urges it from its displaced position outward towards the channel wall distal the area to be masked where it frictionally engages the masking sheet between the end of the retaining means and the channel wall. Placement of the masking sheet is accomplished by stuffing the edges of the sheet into the channel by running a tool along the perimeter of the channel structure, displacing the retaining means inwardly both substantially parallel and at an angle to the channel walls. The resilience of the retaining means causes it to close behind the tool, engaging the masking material and storing any excess material within the channel. After use, the material is removed and the retaining means remains in place for future applications.

15 Claims, 4 Drawing Sheets

MASKING DEVICE

BACKGROUND OF THE INVENTION

1. Field of the Invention

This invention relates generally to masking methods and specifically to a pliable, resilient retaining means integrated with the exterior framing about a window, or other surface area requiring masking, which is inwardly displaceable to allow for the insertion and retention of a masking sheet within a channel beneath the retaining means, creating a built-in, reusable method of masking to protect against substances, such as paint, stucco or plaster, being applied to adjacent walls.

2. Description of the Prior Art

It is known that to mask windows one can carefully apply adhesive tape about the edges of the window pane or molding to secure a masking sheeting comprised of paper or plastic across the window. It is normally necessary to mask the windows in a structure to protect them when applying plaster, paint or some other surface coating substance to the walls containing the windows. Because there is often a need to apply several of layers of substance to the walls, the complete application process may last over a period of several days. Problems occur when wind, rain or other acts, including the application of the surface material to the walls immediately surrounding the window, tear or rip all or part of the sheeting from the window and the process must be delayed in order to apply new masking over the window.

This known masking method is labor intensive and there is additional labor and resources required to remove the masking when the surface operation is completed, including considerable time spent in ensuring the adhesive tape and sheeting are completely removed and then touching up wall areas that the masking inadvertently covered. Likewise, the windows must often be cleaned of any excess surface material that was inadvertently applied to the window and or border surfaces when the adhesive tape and masking sheets are not perfectly aligned along the edges. Another known window masking art is shown in U.S. Pat. No. 2,922,392. This art shows a set of pressure screws which force a pre-cut sheet against a rubber mounted window.

Devices are also known in the prior art to secure sheets of fabric across walls on a framework of channeled track assemblies attached to the walls. These frameworks are known to be formed in both single and multi-piece assemblies. A typical single piece assembly operates with a molded plastic extrusion which includes a hinged edge parallel to its base which locks down on the base to engage the material. Examples of a single piece assembly are found in U.S. Pat. Nos. 4,817,699 and 4,625,490. A multi-piece assembly is taught in U.S. Pat. No. 4,986,332 and operates by locking a free member into a secured base track extrusion, trapping and engaging the material within. In each case, the channeled tracks are of such design that they must be mounted externally to the wall, above its surface.

Other known prior art discloses the use of a multi-piece assembly to secure a rigid or semi rigid window pane within channeled framing utilizing locking, resilient bead flange strips. Such an assembly is taught in U.S. Pat. No. 4,133,367. Likewise, an external two piece extrusion creating a method of securing a secondary pane over the front of an existing window is taught in U.S. Pat. No. 4,333,284. Both of these inventions disclose a manner of utilizing a locking piece to engage the pane or cover within a channel which is either extruding from or installed within the window frame.

SUMMARY OF THE PRESENT INVENTION

The present invention comprises a reusable retaining device for masking material, which is integrated with a window extrusion, or other finishing molding associated with a window mounted in an architectural structure. The device may also be used to mask other surfaces in a structure. The invention includes a channel having an open end proximate an exterior wall adjacent to the window mounting. A pliable, resilient retaining means extends substantially across the channel proximate an open end of the channel.

In preferred embodiments, the retaining means is attached to, integrated with, or otherwise secured to the wall of the channel proximate a window, or other surface area, having a main body part which extends substantially across the channel opening and tapers to end proximate the channel wall distal the window. The retaining means is inwardly displaceable to positions both substantially parallel and perpendicular to the channel walls to allow insertion into the channel of a non-adhesive masking sheet comprised of paper or plastic material. The retaining means is preferably inwardly curved from the channel opening to facilitate the inward displacement and resist outward extension beyond the contact between the tip and the channel wall.

After the masking material is inserted, the resilience of the retaining means urges it from its inwardly displaced position back toward the wall of the channel thereby engaging the masking material between the end of the retaining means and the channel wall. The channel wall may include a single, or multiple spaced ridges which protrude slightly into the channel and receive the end of the retaining means and further secure the engagement of the masking material and prevent inadvertent removal.

The installation and removal of the masking material in the present invention is accomplished using a tool similar to a standard screen roller.

The present invention provides the benefits of standard masking without the need for adhesive cleanup and other touch up work necessitated by imperfect tape alignment. It eliminates the need for adhesive tapes or other means of securing masking material about windows, or other surface areas. It further employs a built-in framework to ensure that the masking sheet is perfectly aligned with the area to be masked off, thus substantially eliminating any touch-up work normally required after the removal of the masking.

The present invention may be employed in the construction industry as an integral portion of window frames and moldings where masking of the windows for painting, plastering, or stuccoing is required.

The invention provides a reusable means for masking the same windows, or other surface areas, without requiring multiple assembly pieces, which are labor intensive and must be carefully stored between masking applications. The reusable nature of the invention better accommodates situations requiring the replacement of masking material due to wind, rain, or other damage as discussed above.

Additionally, the present invention does not require mounting any additional external extrusions about existing window molding extrusions, which are generally not aesthetically desireable on structures.

BRIEF DESCRIPTION OF THE DRAWINGS

For a better understanding of the invention, including the description of present embodiments, reference is made to the accompanying drawings, wherein.

DETAILED DESCRIPTION

The present invention may be used to mask any area of a structure requiring masking protection, not just windows. However, for illustrative purposes, embodiments of the device about window structures are shown.

Figure 1:
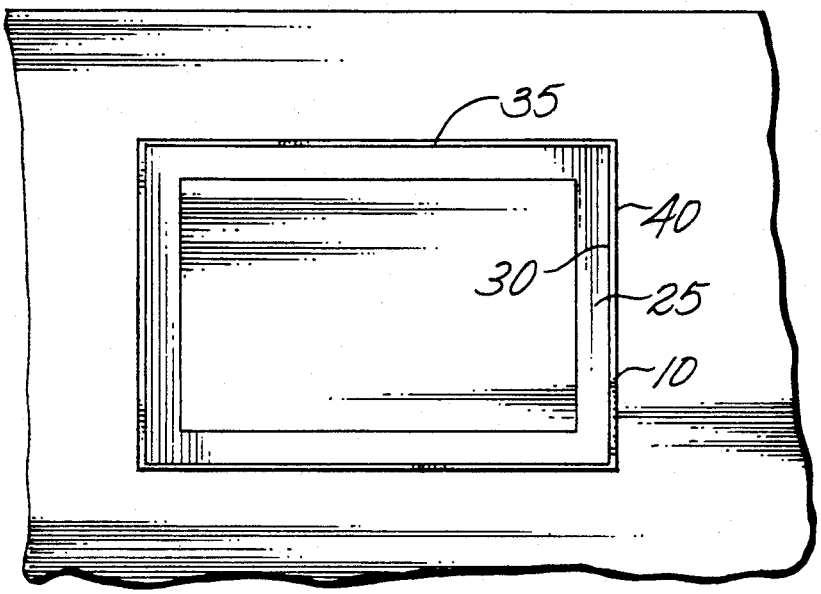
FIG. 1 is a perspective view of an external wall in a structure, containing a window with a first embodiment of the present invention.

Referring now to FIG. 1, there is illustrated a perspective view of an external window, 10, as located in a wall, 15, of an architectural structure. A retaining means, 20, is integrated with a window front extrusion, 25, immediately surrounding the window. The retaining means, described in detail subsequently, is attached to the window front extrusion proximate a first wall, 30, of a channel, 35, and extends substantially across the channel to an end proximate a second wall of the channel, 40.

Figure 2:
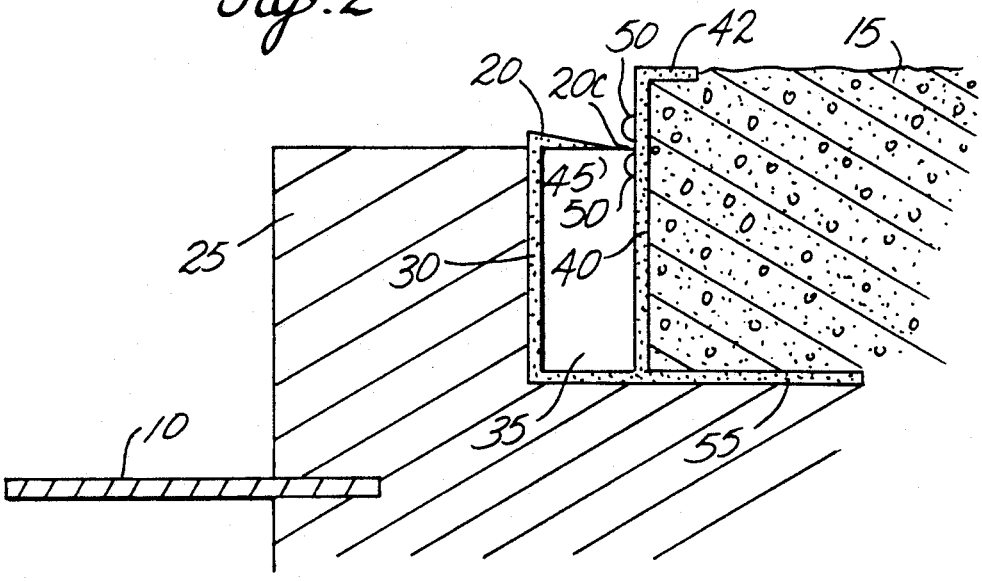
FIG. 2 is a top view of a first embodiment of the present invention, integrated with a storefront extrusion about a window.

Referring now to FIG. 2, there is illustrated a top view of a first embodiment of the present invention. The channel, 35, is shown integrated between the window front extrusion, 25, and the stucco wall, 15. The retaining means, 20, is attached to the first wall of the channel, 30, proximate the window front extrusion and extends substantially across an opening, 45, in the channel tapering to an end, 20(*c*), proximate a second wall of the channel 40 distal the window. The end of the retaining means rests between two, spaced hemispheric ridges, 50, which protrude slightly into the channel and extend along the second channel wall, parallel to it, proximate the opening. The base of the channel, 55, extends into the stucco wall to better secure the integration of the embodiment of the invention shown in FIG. 2 with the wall and the window front extrusion.

A support lip, 42, is attached to the second wall of the channel and comprises a flange extrusion which is perpendicularly attached to the channel wall and embedded flush with the stucco wall.

Figure 3:
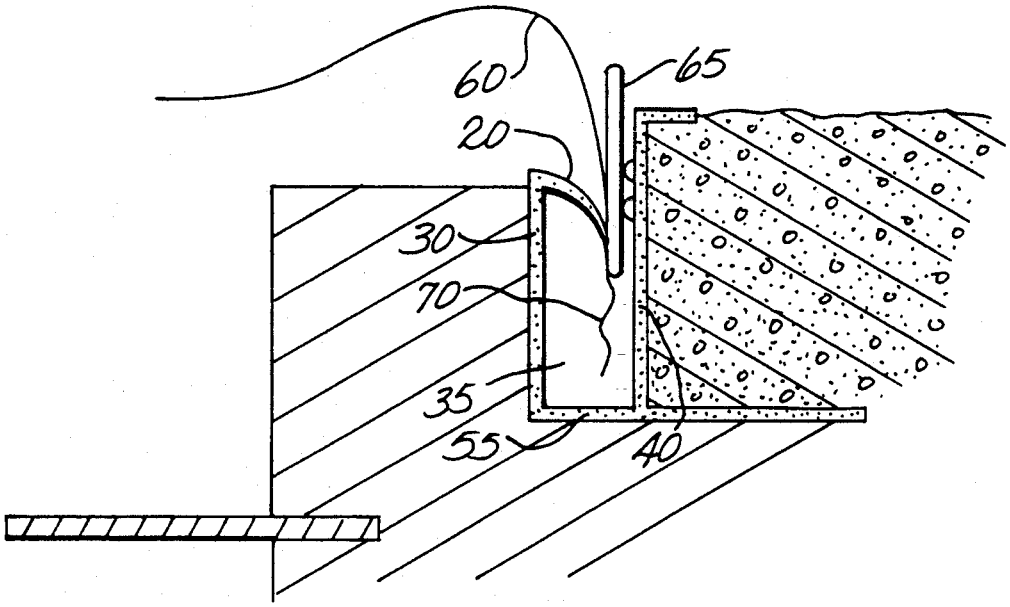
FIG. 3 shows the embodiment of FIG. 2, with the masking tool shown inserting the masking sheet into the channel.

Referring now to FIG. 3, there is illustrated the same view of the first embodiment of the present invention as is shown in FIG. 2, with a masking sheet, 60, being inserted into the channel with the use of a masking insertion tool, 65. An edge of the masking sheet, plus any excess material, 70, is collected in the channel. The masking insertion tool displaces the now inwardly curved retaining means, 20, towards the base of the channel, 55, so that the retaining means is disposed substantially parallel to the walls of the channel.

Figure 4:
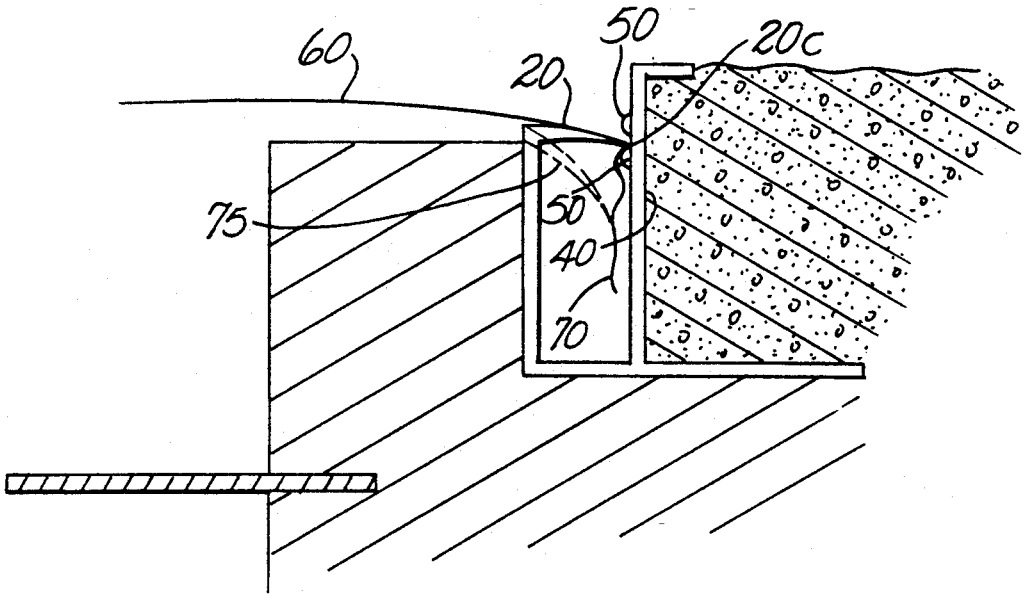
FIG. 4 shows the embodiment of FIG. 2, with the masking sheet engaged between the retainer and the outer channel wall.

Referring now to FIG. 4, there is illustrated the same view of the first embodiment of the present invention as is shown in FIG. 2, but with the masking sheet, 60, engaged between the retaining means and the second channel wall, locked in by the spaced ridges, 50. The resilience of the retaining means urges it to move from its displaced position, 75, along an arcuate path to its original position, where the end of the retaining means, 20(*c*), frictionally engages the masking sheet between the second channel wall and the spaced ridges.

Figure 5:
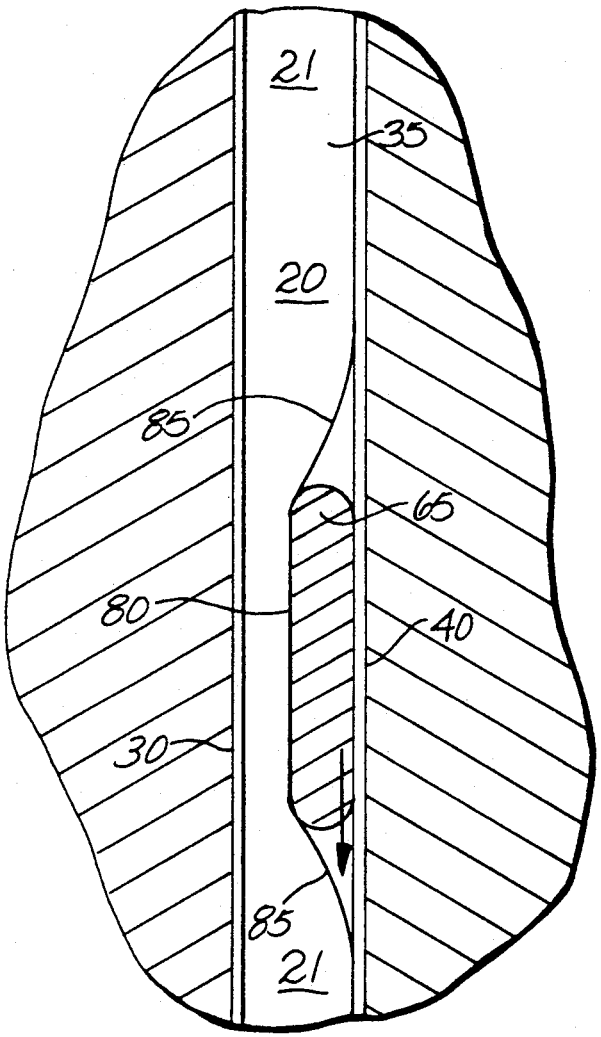
FIG. 5 is a side view of the channel, showing the tool displacing the retainer.

Referring now to FIG. 5, there is illustrated a side view of the first embodiment of the present invention shown in FIG. 2, from the perspective of the base of the channel, which shows the masking insertion tool, 65, displacing the retaining means, 20, to a position that is both substantially parallel to, shown by portion 80, and at an angle from, shown by portion 85, the walls of the channel, 30 and 40. FIG. 5 best illustrates the flexible nature of the retaining means, which is pliable along axes both parallel to and at an angle from the walls of the channel. The retaining means is resilient along these same axes, causing it to restore itself to its original position, shown by portion 21 in FIG. 5, after the tool passes by.

Figure 6:
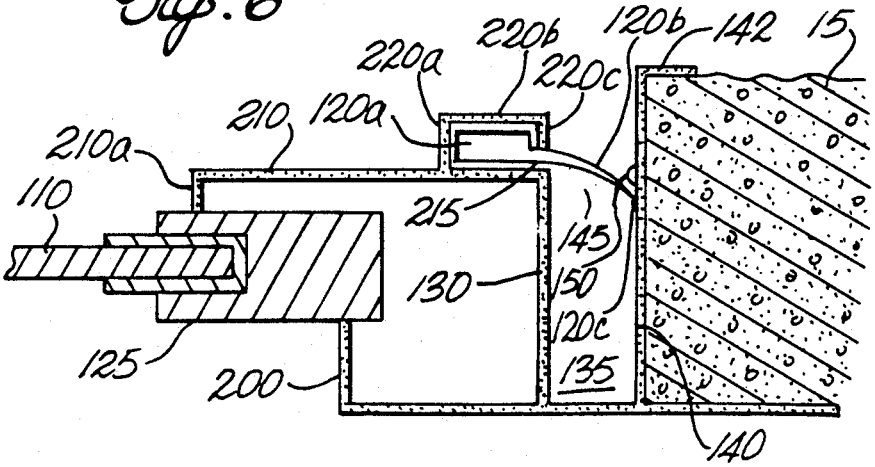
FIG. 6 is a top view of a second embodiment of the present invention, integrated directly with a window extrusion.

Referring now to FIG. 6, there is illustrated a top view of a second embodiment of the present invention. In this embodiment, an assembly comprising a channel, 135, is integrated directly with the window molding, 125, supporting a window, 110, in a stucco wall, 15.

The channel has a first wall, 130, proximate the window molding, a base comprising a window extrusion, 155, a second wall, 140, distal the window molding, and an opening, 145.

The window extrusion, 155, extends away from the window beyond the second channel wall and into the stucco wall, 15, as well as towards the window beyond the first channel wall and is attached perpendicularly to a flange extrusion, 200, which is engaged with the window molding.

A flange member 210, which extends parallel to the window pane, 110, and is engaged with the window molding, 210(*a*), is perpendicularly attached to the first wall of the channel proximate the channel opening. Flange extrusion 220(*a*) is perpendicularly attached to flange 210, extending away from the structure, parallel to the channel walls, forming a right angle with flange 220(*b*), which extends parallel to flange 210, towards the channel. Flange 220(*c*) perpendicularly joins 220(*b*) at a point substantially flush with the first wall of the channel extending in a direction towards the base of the channel, 155, and, along with flanges 210, 220(*a*) and 220(*b*), creates an enclosure with an opening, 215, of a limited cross-sectional area, substantially less than the cross-sectional area of flange 220(*a*).

The retaining means, 120, in the second embodiment has two main body portions. The first body portion, 120(*a*), has a cross-sectional area substantially greater than the second body portion, 120(*b*), and also substantially greater than that of opening 215 of the enclosure created by flanges 210, 220(*a*), 220(*b*) and 220(*c*). As such, the first body portion of the retaining means is secured within this enclosure, with the second body portion of the retaining means protruding from opening 215 and extending substantially across the channel opening, tapering to an end, 120(*c*), proximate the second channel wall.

In this embodiment, the second body portion of the retaining means is inwardly curved and rests with the tapered end against the hemispheric ridge, 150, which protrudes slightly from the second wall of the channel extending along the second channel wall, parallel to the opening of the channel, 145.

The second wall of the channel is attached to a support lip, 142, which comprises a flange extrusion perpendicularly attached to the channel second wall and embedded nearly flush with the stucco wall, 15.

Insertion and retention of the masking sheet to this second preferred embodiment is substantially identical to the process shown for the first preferred embodiment in FIGS. 3-5.

Figure 7:
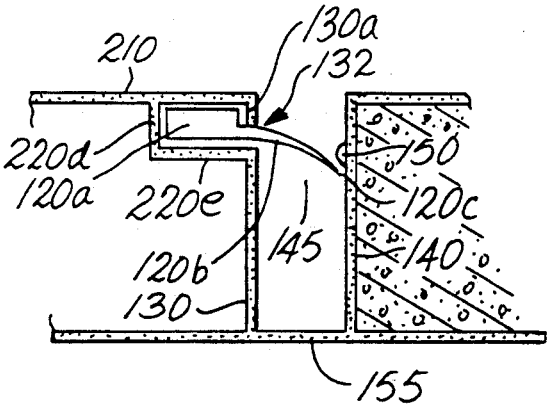
FIG. 7 is a top view of third embodiment of the retaining means in the present invention.

Referring now to FIG. 7, there is illustrated a side view of a third embodiment of the retaining means of the present invention, which is substantially similar to that illustrated in FIG. 6, with a modification of the means for securing the retaining means.

In this embodiment, flange member 220(*d*), is perpendicularly attached to flange 210, and extends into the structure, parallel to the channel walls, 130 and 140, and forming a right angle with flange 220(*e*). Flange 220(*e*) extends parallel to flange 210, toward the channel, meeting the first channel wall, 130, which terminates at this junction. Flange extrusion 130(*a*) forms a right angle with flange 210 and extends toward the base of the channel, 155, substantially along the same line as the first channel wall, but stopping before reaching the intersection of the first channel wall and flange 220(*a*), leaving an opening, 132, in the first channel wall. This opening has a limited cross-sectional area, which is substantially less than the cross-sectional area of flange 220(*d*).

The retaining means, 120, in the third embodiment, like that shown in the second embodiment, has two main body portions. The first body portion, 120(*a*), has a cross-sectional area substantially greater than the second body portion, 120(*b*), and also substantially greater than that of opening 132 in the first channel wall. The first body portion of the retaining means is secured in the enclosure created by flange's 210, 220(*d*), 220(*e*) and 130(*a*), with the second body portion of the retaining means protruding from opening 132 and extending substantially across the channel opening, tapering to an end, 120(*c*), proximate the second channel wall, 140.

In this embodiment, the second body portion of the retaining means is inwardly curved and rests with the tapered end against the hemispheric ridge, 150, which protrudes slightly from the second wall of the channel extending along the second channel wall, parallel to the opening of the channel, 145.

In view of the forgoing, it is evident that the present invention offers a reusable means of easily applying and removing masking material from windows, in a manner that the masking sheet covers exactly what is within the four outer channel walls. Likewise, the present invention may be used in masking applications for other structural areas requiring masking protection.

Having now described the invention in detail, as required by the patent statutes, those skilled in the art will recognize modifications and substitutions for elements of the embodiments disclosed. Such substitutions and modifications fall within the intent and scope of the present invention as defined by the following claims.

What is claimed is:

1. A reusable masking device for securing masking material, said device integrated with a surface area to be masked in an architectural structure comprising:

a channel having a first wall proximate the surface area, a base, a second wall distal the surface area and an opening, said first and second wall being substantially perpendicular to said surface area, and a flexible, resilient retaining means for securing the masking material attached to the channel first wall, the retaining means having a body portion which extends substantially across the channel opening and tapers to an end proximate the channel second wall, the body portion inwardly displaceable towards the base of the channel and outwardly resilient towards the channel second wall, thereby allowing the masking material to be inserted into the channel and, wherein the masking material is frictionally engaged between the end of the retaining means and the channel second wall.

2. A reusable masking device as defined in claim 1 wherein the area to be masked comprises a window.

3. A reusable masking device as defined in claim 1 further comprising:

a substantially hemispheric ridge protruding into the channel from the channel second wall, said ridge located proximate the end of the retaining means, the retaining means resiliently urging the masking material against said ridge.

4. A reusable masking device as defined in claim 1 further comprising:

two substantially parallel hemispheric ridges protruding into the channel area from the second wall said hemispheric ridges receiving the end of the retaining means therebetween and spaced such that the retaining means engages the material between the ridges against the channel second wall.

5. A reusable masking device as defined in claim 1 further comprising:

a flange extrusion attached to the channel second wall proximate the channel opening and extending in a direction away from the channel opening and substantially parallel to a structural wall containing the area to be masked, an outward face of the extrusion substantially flush with an exterior face of the structural wall, thereby providing a means to secure the masking device with the structural wall.

6. A reusable masking device as defined in claim 1 wherein the base of the channel extends beyond the channel second wall into a structural wall containing the area to be masked, in a direction substantially parallel to the structural wall, wherein the base extension is secured within the structural wall thereby providing a means of securing the masking device with the wall.

7. A reusable masking device as defined in claim wherein the retaining means is inwardly displaceable in a direction both substantially parallel and at an angle from the channel second wall, such that the retaining means may be inwardly disposed at any angle to the channel second wall.

8. A reusable masking device as defined in claim wherein the body portion of the retaining means is inwardly curved from the channel opening to facilitate inward displacement and resist outward extension beyond the contact between a tapered end of the retaining means and the channel second wall.

9. A reusable window masking device integrated with the molding of a window in an architectural structure for securing masking material to the window, the masking device comprising:

a channel having a first wall proximate the window, a base which is an extrusion of the molding, a second wall distal the window, and a base, the channel attached to a flange member which extends away from the channel opening substantially perpendicular to the channel first wall and is integrated with the window molding, a flexible, resilient retaining means attached to the channel first wall, having a body portion which extends substantially across the channel opening and tapers to an end proximate the channel second wall, the retaining means inwardly displaceable towards the base of the channel and outwardly resilient towards the channel second wall, whereby the masking material can be inserted into the channel and wherein the masking material is frictionally engaged between the end of the retaining means and the channel second wall.

10. A reusable window masking device as defined in claim 9 further comprising:

a substantially hemispheric ridge protruding into the channel from the channel second wall, said ridge located proximate the end of the retaining means, the retaining means resiliently urging the masking material against said ridge.

11. A reusable window masking device as defined in claim 9 further comprising:

two substantially parallel hemispheric ridges protruding into the channel from the channel second wall said hemispheric ridges receiving the end of the retaining means therebetween and spaced such that the retaining means engages the material between the ridges against the channel second wall.

12. A reusable window masking device as defined in claim 9 wherein the retaining means is inwardly displaceable in a direction both substantially parallel and at an angle from the channel second wall, such that the retaining means may be inwardly disposed at any angle to the channel second wall.

13. A reusable window masking device as defined in claim 9 wherein the main body portion of the retaining means is inwardly curved from the channel opening to facilitate inward displacement and resist outward extension beyond the contact between a tapered end of the retaining means and the channel second wall.

14. A reusable masking device for securing masking material, said device integrated with a surface area to be masked in an architectural structure comprising:

a channel having a first wall proximate the surface area, a base, a second wall distal the surface area, and an opening, and a flexible, resilient retaining means for securing the masking material, the retaining means attached proximate the channel opening by a plurality of flange members extending from a first flange member, the first flange member extending perpendicularly from and attached to the first channel wall, which are successively attached substantially perpendicular to each other, creating an enclosure with an opening of limited cross-sectional area that locks in a first body portion of the retaining means having a larger cross-sectional area than the opening, thereby allowing a second body portion of the retaining means with a smaller cross-sectional area to protrude from the opening, the second body portion extending substantially across the channel opening and tapering to an end proximate the channel second wall, the second body portion inwardly displaceable toward the base of the channel and outwardly resilient toward the channel second wall, thereby allowing the masking material to be inserted into the channel and, wherein the masking material is frictionally engaged between the end of he retaining means and the channel second wall.

15. A reusable window masking device integrated with the molding of a window in an architectural structure for securing masking material to the window, the masking device comprising:

a channel having a first wall proximate the window, a base which is an extrusion of the molding, a second wall distal the window, and a base, the channel attached to a flange member which extends away from the channel opening, substantially perpendicular to the channel first wall and is integrated with the window molding, a flexible, resilient retaining means secured proximate the channel opening by a plurality of flange members extending from a first flange member, the first flange member extending perpendicularly from and attached to the first channel wall, which are successively attached substantially perpendicular to each other, creating an enclosure with an opening of limited cross-sectional area that locks in a first body portion of the retaining means having a larger cross-sectional area than the opening, thereby allowing a second body portion of the retaining means with a smaller cross-sectional area to protrude from the opening, the second body portion extending substantially across the channel opening and tapering to an end proximate the channel second wall, the second body portion inwardly displaceable towards the base of the channel and outwardly resilient toward the channel second wall, whereby the masking material can be inserted into the channel and where in the masking material is frictionally engaged between the end of the retaining means and the channel second wall.

* * * * *

UNITED STATES PATENT AND TRADEMARK OFFICE

CERTIFICATE OF CORRECTION

PATENT NO. :5,230,738

DATED :July 27, 1993

INVENTOR(S) :Robert A. Wheeler

It is certified that error appears in the above-indentified patent and that said Letters Patent is hereby corrected as shown below:

On the title page:

[56] References Cited, U.S. PATENT DOCUMENTS,
change "Re. 32,508 9/1987 Werner..." to
-- Re. 32,509 9/1987 Werner... --; and
change "3,429,296 2/1969 Legre...." to
-- 3,429,296 2/1969 Legere... --.

Column 6, line 57, after "claim" insert -- 1 --.
Column 6, line 64, after "claim" insert -- 1 --.

Column 8, line 26, before "retaining" change "he" to
-- the --.

Signed and Sealed this

Eighth Day of March, 1994

*Attest:*

*Attesting Officer*

BRUCE LEHMAN

*Commissioner of Patents and Trademarks*